United States Patent [19]

Miller

[11] 4,352,706

[45] Oct. 5, 1982

[54] PROCESS FOR APPLYING A METALLIC IMAGE IN REGISTER TO A DOCUMENT OF VALUE

[76] Inventor: Lee H. Miller, 900 Park Ave., New York, N.Y. 10021

[21] Appl. No.: 298,090

[22] Filed: Aug. 31, 1981

[51] Int. Cl.[3] ..... B44C 1/00

[52] U.S. Cl. ..... 156/233; 156/230; 156/234; 156/235; 156/239; 428/914; 283/8 B; 427/7; 40/453

[58] Field of Search ..... 283/8 B, 8 R; 427/7; 40/453; 428/914, 915, 916, 30; 156/230, 233, 234, 235, 239, 240, 241

[56] References Cited

U.S. PATENT DOCUMENTS

| | | | |
|---|---|---|---|
| 4,066,280 | 1/1978 | LaCapria | 283/8 R |
| 4,215,170 | 7/1980 | Vilaprinyo-Oliva | 156/233 |
| 4,303,307 | 12/1981 | Tureck et al. | 428/916 |

OTHER PUBLICATIONS

Optical Interference Coatings for Inhibiting of Counterfeiting, Dobrowolski et al. National Research Council of Canada 12/73, pp. 925–937.

*Primary Examiner*—Edward C. Kimlin
*Assistant Examiner*—F. K. Wine
*Attorney, Agent, or Firm*—Lieberman, Rudolph & Nowak

[57] ABSTRACT

A valuable document is protected from counterfeiting by applying an extremely thin layer of metal to the document at predetermined locations. The thin layers of metal form a "ghost image" which changes in appearance as the angle of view is varied, making the valuable document easily recognizable by a lay observer. The portions of the valuable document covered by the thin layers of metal reflect ultra-violet and infra-red light making a photocopy of the valuable document strikingly different in appearance than the original document. Counterfeiting the document by any method is extremely difficult as the process of applying the thin layers of metal is one of high technology, not readily available to the public.

3 Claims, 1 Drawing Figure

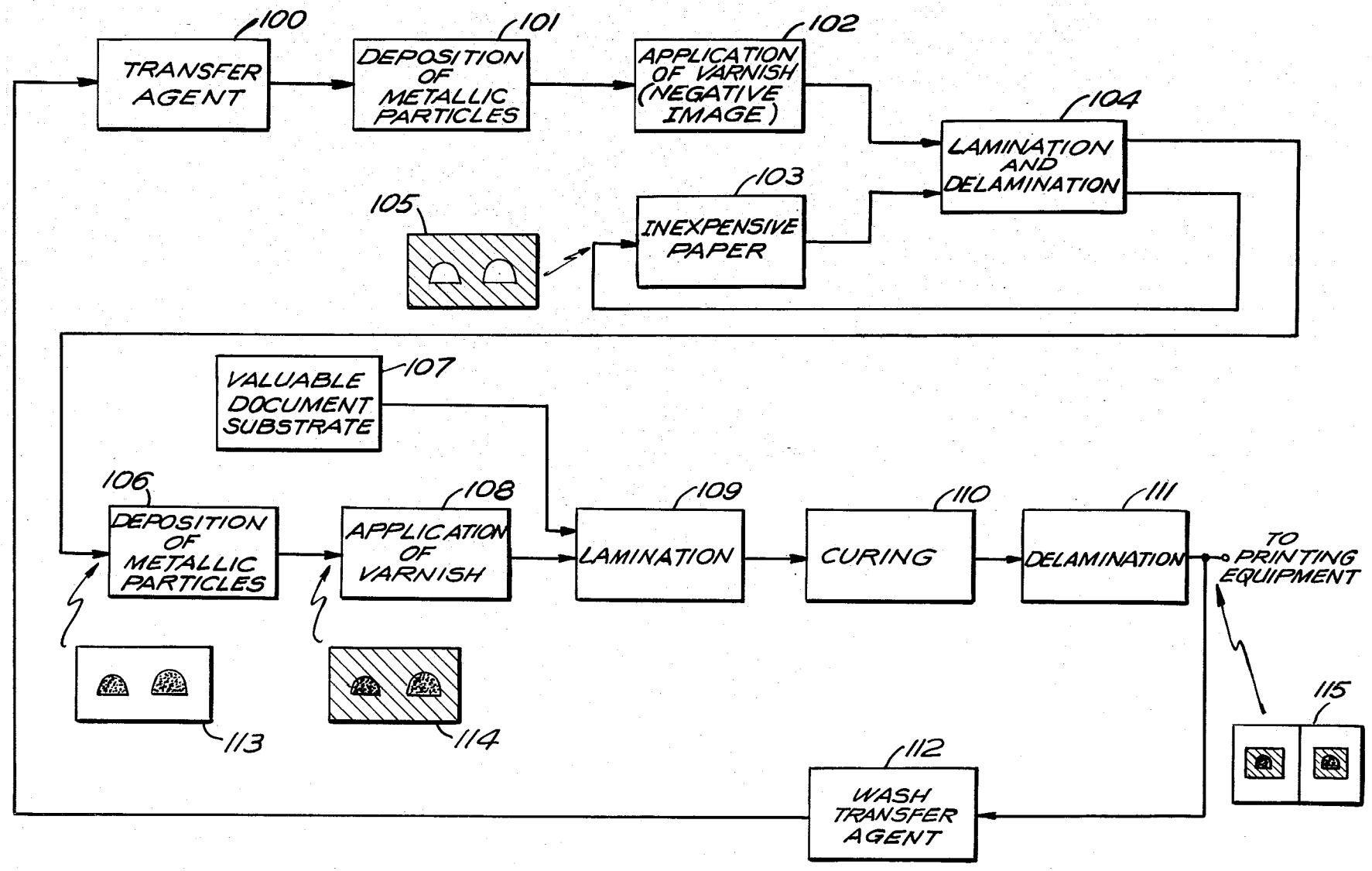
TRANSFER AGENT
100
DEPOSITION OF METALLIC PARTICLES
101
APPLICATION OF VARNISH (NEGATIVE IMAGE)
102
INEXPENSIVE PAPER
103
105
LAMINATION AND DELAMINATION
104
VALUABLE DOCUMENT SUBSTRATE
107
DEPOSITION OF METALLIC PARTICLES
106
APPLICATION OF VARNISH
108
LAMINATION
109
CURING
110
DELAMINATION
111
TO PRINTING EQUIPMENT
WASH TRANSFER AGENT
112
113
114
115

PROCESS FOR APPLYING A METALLIC IMAGE IN REGISTER TO A DOCUMENT OF VALUE

FIELD OF THE INVENTION

This invention relates to printed matter and more particularly to a novel and improved process for preventing the counterfeiting of documents of value such as bonds, bank notes, stock certificates and the like.

BACKGROUND OF THE INVENTION

The counterfeiting of valuable documents such as bank notes, bonds, stock certificates, credit cards, and stamps has been, and continues to be, of major concern to government agencies, banking institutions and security firms.

This concern has greatly increased in the recent past as modern photocopy methods continue to improve. Present day photocopiers already have the capability to make faithful color reproductions of valuable documents which are of sufficient quality to pass a casual inspection by a lay observer. As a specific example dollar bills have been copied and the copies successfully used in dollar bill changers.

Continuing improvement in photocopy technology will exacerbate the problem of counterfeiting. It is anticipated that photocopies will be of such quality within the next five years that skilled personnel using the most sophisticated and advanced detection equipment will be required to detect counterfeit documents. As counterfeit documents are normally passed through lay personnel, lacking even rudimentary detection equipment, it is clear that counterfeiting through the use of photocopy techniques will soon become an uncontrollable problem.

Various techniques have been proposed in the past to permit detection by a lay person of a counterfeit document. Such techniques are described for example in U.S. Pat. No. 4,033,059 granted to R. G. Hutton et al on July 5, 1977 and U.S. Pat. No. 4,124,947 granted to Adolf Kuhl et al. on Nov. 18, 1978. The technique described in both patents is similar and involves imprinting inked intaglio pattern elements, such as lines, on a document of value. As is well known, an intaglio imprint is obtained by pressing paper, or other substrates, against an engraved plate which is inked whereby the substrate is deformed (i.e. raised images are created) while being inked. The pattern elements are arranged to form background portions and readily recognizable image portions by making the pattern elements, which form the image portions, different in depth and orientation from the pattern elements which form the background portions. Varying orientation and depth of the pattern elements, in combination with inking, results in an image portion which blends with the background portion from one angle of view but which appears as a readily recognizable symbol from another angle of view. Such an image which varies in appearance when the angle of view is changed, is known as a "latent image".

A latent image, when imprinted when intaglio techniques on a document of value, is readily observed by a lay observer as the image appears and disappears as the observer varies his angle of view. This phenomenon results from the unique arrangement of pattern elements discussed above and is not observable on the portions of a document lacking the arrangement of pattern elements. However, when a photocopy is made of such a document it is, of course, made from a fixed angle of view. Therefore, the photocopy will contain only one aspect of the image, either the image of the readily recognizable symbol or the image blended into the background, with the copied aspect being dependent on which angle of view is chosen. Accordingly, a lay observer has no difficulty in detecting a photocopy counterfeit as the image will not change as the angle of view is varied.

Although the technique described in the U.S. patents discussed above has certain advantages over other methods of detecting counterfeit documents, several problems remain. First, the image must be inked to make it visible, with the color of the raised portion of the image necessarily being different than the color of the underlying document substrate. The necessity for inking adds expense and complexity to the process making it less desirable to a wide variety of users.

A second problem is that great care must be taken to create an image that is clearly visible from one angle of view and essentially invisible from a second angle of view. Unless great care is taken in creating the image it will be visible from any angle of view, completely destroying the advantage of detecting counterfeit documents with a latent image.

Still another problem with the prior art methods is if a color photocopy is made of the latent image the color of the copy may be the same as the original, although of course the latent image effect will be lost. The fact that the colors are the same makes detection of a counterfeit document more difficult.

It is therefore an object of the present invention to provide a process for protecting valuable documents that does not have the disadvantages of the processes described above.

It is a further object of the present invention to provide a method for protecting valuable documents that is inexpensive and readily used by printers equipped for security printing.

It is a still further and general object of the present invention to provide a method for protecting valuable documents that can be used by a lay observer without the need for detection equipment.

SUMMARY OF THE INVENTION

In accordance with the invention a valuable document is protected from counterfeiting by applying extremely thin layers of metal to the document at predetermined locations.

It is a feature of the invention that a first layer of metal is applied to the document at a first predetermined location and a second layer of metal, partially overlaying said first layer of metal is applied to said document at a second predetermined location.

It is another feature of the invention that said first and second layers of metal form, in combination, an image that takes on a first appearance from a first angle of view and a second appearance from a second angle of view.

It is a further feature of the invention that the portions of the valuable document covered by said first and second layers of metal reflect ultra-violet and infra-red light, making a photocopy of said valuable document easily recognizable by a lay observer.

It is a still further feature of the invention that applying the thin layer of metal to the valuable document makes any method of counterfeiting extremely difficult as the process is one of high technology not readily available to the public.

It is another feature of the invention that metallic layers are extremely thin, such that they are virtually flush with the substrate of the document.

The foregoing and other objects and features of this invention will be more fully understood from the following description of an illustrative embodiment thereof taken in conjunction with the accompanying drawing.

BRIEF DESCRIPTION OF THE DRAWING

The FIGURE of the drawing illustrates a block diagram of the process of the instant invention which protects a valuable document from counterfeiting.

DETAILED DESCRIPTION

The instant invention is directed to a process for preventing the counterfeiting of valuable documents by applying extremely thin layers of metal to the document at predetermined locations. Application of the thin metal layers to a valuable document prevents counterfeiting by photocopying techniques since the metallized surface reflects both ultra-violet and infra-red light. Therefore, the portion of the document covered by the metallized surface will not be reproduced when the document is copied.

Counterfeiting by other methods is also made extremely difficult because the technology necessary to perform the metallization process is only available to security printers and the like and not readily obtainable by the general public. Finally, and most importantly, the inventive process creates a "ghost image" on the metallized surface which is similar to the "latent image" utilized in the prior art discussed above. The "ghost image" on the document seems to appear and disappear as the document is viewed from different angles making a genuine document easy to identify by a lay observer. Also, of course, since the "ghost image" effect is lost when copied the difference between a genuine document and a counterfeit photocopy is striking.

The basic underlying process by which a metallized surface is applied to a document substrate is set forth in U.S. Pat. No. 4,215,170 granted to D. Entique Vilaprinyo Oliva on July 29, 1980 and the teachings of this patent are hereby incorporated in this application by reference. Briefly the process described in U.S. Pat. No. 4,215,170 involves an extremely thin coat of metallic particles on a finely finished transfer agent in a conventional vacuum chamber. The transfer agent is preferably in the form of an elongated web of plastic material such as untreated polypropylene, polyester, polyethylene, polyvinyl chloride or the like which may be fed by roller means. The exact method of metal description is described in U.S. Pat. No. 4,215,170 and as stated therein metallic layers with a thickness substantially less than 500 Angstroms can be deposited on the transfer agent.

Subsequent to the deposition of metal on the transfer agent a thin coat of varnish is applied to either the transfer agent or the substrate to be metallized. The substrate may be in web or sheet form and have a rough or smooth surface. The varnish serves both as a vehicle for producing, in conjunction with the transfer agent, a smooth specular surface on the finished product, and as an adhesive which transfers the deposited metallic particles from the transfer agent to the document substrate. It is a feature of the process described in U.S. Pat. No. 4,215,170 that while the varnish will adhere to the document substrate it will not adhere to the transfer agent.

After varnishing the transfer agent and substrate are laminated together before the varnish has cured. This is preferably accomplished by rolling the substrate and transfer agent into a single roll under slight pressure. The varnish absorbs the metallic particles, transfers them to the substrate and the resultant surface on the substrate takes on the smooth surface characteristic of the transfer agent once it is removed.

The next step in the process described in U.S. Pat. No. 4,215,170 is to cure the laminated substrate and transfer agent. Curing may be done with nautral drying (approximately 24 hours) or may be accelerated with heat or exposure to radiation. After curing the transfer agent and substrate are separated onto two separate rollers and at this point the embedded metal particles will have become permanently adhered to the substrate. The substrate will now have a smooth, specular metallic coating which will appear as continuous and smooth because any interstices or spaces between the metallic particles permit very little light transmission. The process described in U.S. Pat. No. 4,215,170 can be applied to any paper, board or other substrate with no special pre-coating requirements, there are no special moisture requirements because no moisture is removed from the document substrate and the process is considerably less expensive than direct metallization. Also, of course, since the resultant metal layer is so thin, it is virtually flush with the underlying substrate.

Referring now to the figure the process of the instant invention will be described. Transfer agent 100 is metallized at step 101 so that a thin metallic coating of aluminum (or some other metal), on the order of 100 Angstroms to 500 Angstroms, is deposited on the transfer agent. The metallized transfer agent is next varnished at step 102 wherein a thin coat of varnish is applied in the negative image of the desired "ghost image," i.e. the varnish is applied everywhere except where a metallic image is to be left on the transfer agent. The varnish is applied with a gravure coating/laminating machine so that it may be applied in register. The particular "ghost image" shown in the FIGURE is the Liberty Bell (see 105) but it should be understood that any form of "ghost image" may be created.

After application of the varnish the transfer agent and an inexpensive paper substrate (103) are laminated together at step 104. This lamination process transfers the deposited metallic particles to the inexpensive paper in the manner described above with the transfer occurring only on those areas of the transfer agent which have been selectively coated with varnish. After delamination, at step 104, the paper appears as symbolically shown at 105 and the transfer agent appears as symbolically shown at 113. That is the transfer agent is still coated with metallic particles on the darkened areas (113) while the remaining metallic particles have been transferred to the shaded areas of the paper (105). The inexpensive paper may be used (as shown) on its reverse side or it may be destroyed.

The selectively metallized transfer agent is next remetallized at step 106 with a second coating on the order of 100 Angstroms to 500 Angstroms. This results in two layers of metal being deposited on the "ghost image" portion of the transfer agent with remaining portions of the transfer agent having only one layer of metal. This is symbolically shown at 114.

A second gravure coater/laminator is used at step 108 to selectively apply varnish over the ghost image portion of the transfer film and over a background area surrounding the ghost image. The background area can take the shape of a square, as symbolically shown at 115, or any other desired shape.

The selectively coated transfer agent and the valuable document substrate (107) are laminated together in register at step 109. This transfers only the varnish coated metallic particles to the valuable document substrate in the manner described above such that the valuable document now includes a two layer "ghost image" surrounded by a single background area. This step may also include the application of registration marks to the document substrate to assure accuracy in later cutting or subdividing steps. The registration marks would be engraved on the laminating cylinders as is well known in the art.

After lamination the transfer agent and document substrate are cured at step 110 and delaminated as step 111. The resultant product is symbolically shown at 115 and consists of a valuable document substrate bearing a very thin metallic film(s) at predetermined locations. The substrate can now be cut into appropriate separate documents with the aid of the registration marks shown at 115 and/or transferred to conventional printing equipment for suitable engraving. Any subsequent engraving or printing process should not include the "ghost image" and its surrounding background area. The transfer agent is cleansed of any remaining metallic particles at step 112 and returned to the beginning of the production cycle for reuse.

What has been described is a unique process for preventing the counterfeiting of valuable documents by selectively applying extremely thin layers of metallic particles to the document at predetermined locations. The process results in a valuable document which can be readily authenticated by even a lay observer since the "ghost image" will seem to appear and disappear as the angle of view is varied. Counterfeiting by photocopying techniques is rendered impossible since the metallized portion of the document reflects both ultraviolet and infra-red light. Counterfeiting by other methods is also extremely difficult since the high technology necessary to produce the metallized film is difficiult to obtain and properly operate with unskilled personnel.

Although a specific embodiment of this invention has been shown and described, it will be understood that various modifications may be made without departing from the spirit of this invention. These modifications may include varying the size and thickness of the metallic layers, the number and location of the metallic layers, the location of the layers and embossing patterns or symbols on the metallic layers.

What is claimed is:

1. A process for preventing the counterfeiting of a valuable document, comprising the steps of, depositing, on a reusable transfer agent, a first film of metallic particles of the order of magnitude of substantially less than 1,000 Angstroms in thickness, coating a first predetermined area of said transfer agent with varnish, laminating said transfer agent and a first substrate together before said varnish is cured so that said metallic particles are embedded in said varnish at said first predetermined area and transferred to said first substrate, separating said transfer agent and said first substrate whereby said metallic particles outside of said coated first predetermined area remain deposited on said transfer agent, depositing, on said reusable transfer agent, a second film of metallic particles of the order of magnitude of substantially less than 1,000 Angstroms, coating a second predetermined area of said transfer agent with varnish, laminating a second substrate comprising the valuable document and said transfer agent together before said varnish is cured so that said metallic particles are embedded in said varnish at said second predetermined area and transferred to said second substrate, curing said varnish coating on said second predetermined area, separating said second substrate from said transfer agent whereby said second substrate is provided with at least one film of metallic particles at a first predetermined location and at least two films of metallic particles at a second predetermined location and cleaning said reusable transfer agent.

2. A process in accordance with claim 1 further wherein said second substrate may include a plurality of separate valuable documents, the process further including the step of separating said second substrate into a plurality of separate valuable documents, each valuable document having thereon said films of metallic particles at predetermined locations.

3. A process in accordance with claim 1 wherein said coating steps are performed in register with a gravure coater/laminator.

* * * * *